US006533430B2

(12) United States Patent
Baranyai

(10) Patent No.: US 6,533,430 B2
(45) Date of Patent: Mar. 18, 2003

(54) MODEL TRAIN ACCESSORY INCORPORATING LIGHTED TUBE FOR VISUAL EFFECT

(76) Inventor: Gary A. Baranyai, 9 Clydehurst Dr., St. Louis, MO (US) 63119-2011

( * ) Notice: Subject to any disclaimer, the term of this patent is extended or adjusted under 35 U.S.C. 154(b) by 0 days.

(21) Appl. No.: 09/727,619

(22) Filed: Dec. 1, 2000

(65) Prior Publication Data

US 2002/0067607 A1 Jun. 6, 2002

(51) Int. Cl.[7] ..... F21V 33/00
(52) U.S. Cl. ..... 362/101; 362/96
(58) Field of Search ..... 362/96, 101, 267, 362/318, 806; 40/406, 407, 408, 439, 440, 441, 477, 479, 480

(56) References Cited

U.S. PATENT DOCUMENTS

| | | | | |
|---|---|---|---|---|
| 1,972,155 A | | 9/1934 | McMaster | |
| 1,977,093 A | | 10/1934 | Sechi | |
| 2,072,841 A | * | 3/1937 | Tracey et al. | 40/406 |
| 2,174,446 A | | 9/1939 | Otis | |
| 2,353,063 A | | 7/1944 | Otis | |
| 2,378,934 A | | 6/1945 | Kloner | |
| 2,412,171 A | | 12/1946 | Petry | |
| 2,453,176 A | | 11/1948 | Abramson | |
| 3,392,466 A | | 7/1968 | Giudice | |
| 3,711,698 A | | 1/1973 | Hess | |
| 5,109,620 A | * | 5/1992 | Torrence | 40/406 |

OTHER PUBLICATIONS

Lionel Classic Trains 2000 Catalog, vol. 1, p. 85.

* cited by examiner

*Primary Examiner*—Y. My Quach-Lee
(74) *Attorney, Agent, or Firm*—Michael J. Thomas; Harness, Dickey & Pierce, P.L.C.

(57) ABSTRACT

A model train accessory incorporating a transparent vessel coupled with a pipe member to simulate the conveyance of a liquid through the vessel and pipe member. The transparent vessel, containing a liquid that bubbles when heated, is secured to one end of a pipe fitting with a grommet. A light bulb assembly is secured to the opposite end of the pipe fitting with a grommet to direct heat and light into the transparent vessel to heat the liquid. A pipe member is connected to the transparent vessel such that it appears the liquid flows through the vessel and pipe member. The vessel can be positioned in a transparent tube to further resemble authentic industrial piping. This model train accessory may be connected via the pipe fitting to a support surface for placement on a model train layout.

18 Claims, 3 Drawing Sheets

MODEL TRAIN ACCESSORY INCORPORATING LIGHTED TUBE FOR VISUAL EFFECT

BACKGROUND OF THE INVENTION

The present invention relates generally to model train accessories and, more particularly, to model train accessories incorporating lighted transparent vessels containing a liquid and connected to a pipe member to simulate the flow of liquid through the vessel and pipe member.

Various model train accessories, such as trees, buildings, bridges, tunnels, crossing gates, railroad signals, etc. have been used with model train sets to add realism to train set layouts. There is, however, a continuing desire to develop more realistic and authentic accessories for model train sets. One development suggests the use of a clear tube to simulate liquid flowing through the tube. For example, the Lionel Classic Trains 2000 Catalog, Volume 1, discloses, at page 85, the use of a bubbling tube to simulate oil being pumped from an oil derrick. Nothing in the prior art, however, suggests a model train accessory that simulates the flow of liquid through a pipe assembly.

As recognized by the inventor hereof, what is needed is a device that resembles authentic industrial piping to simulate the conveyance of a liquid, such as water, gas, oil, etc., through the piping.

SUMMARY OF THE INVENTION

In order to solve these needs in the art, the inventor hereof has designed and developed a model train accessory that incorporates a transparent vessel coupled with a pipe member to simulate the conveyance of a liquid through the vessel and pipe member. In general, the transparent vessel, containing a liquid that bubbles when heated, is secured to one end of a pipe fitting with a grommet. A light bulb assembly is secured to the opposite end of the pipe fitting with a grommet to direct heat and light into the transparent vessel to heat the liquid. A pipe member is connected to the transparent vessel such that it appears the liquid flows through the vessel and pipe member. The vessel can be positioned in a transparent tube to further resemble authentic industrial piping. This model train accessory may be connected via the pipe fitting to a support surface for placement on a model train layout.

In accordance with one aspect of the present invention, a model train accessory comprises a bubble vial and at least one pipe member, the bubble vial being coupled to the pipe member to simulate the flow of liquid through the pipe member.

In accordance with another aspect of the present invention, a model train accessory includes a vessel for containing a liquid, the vessel having a top end, a bottom end, and a sidewall extending between the top end and the bottom end, a pipe fitting having at least one opening adapted for receiving a pipe member, and a grommet having an inner peripheral edge and an outer peripheral edge, the inner peripheral edge of the grommet extending about and engaging the sidewall of the vessel, the outer peripheral edge of the grommet being seated within the opening of the pipe fitting, the grommet thereby securing the vessel to the pipe fitting.

In accordance with still another aspect of the present invention, a model train accessory comprises a light assembly including a bulb portion and a base, a pipe fitting having a top end and a bottom end and at least one opening extending therein, and a grommet having an inner peripheral edge and an outer peripheral edge, the inner peripheral edge of the grommet extending about and engaging the base of said light assembly, the outer peripheral edge of the grommet being seated within the pipe fitting opening in the bottom end of the pipe fitting, the grommet thereby securing the light assembly to the pipe fitting.

In accordance with yet another aspect of the present invention, a model train accessory comprises a bubble vial having a top end, a bottom end, and a sidewall extending between the top end and the bottom end, a tube member having a top end, a bottom end, and an opening extending between the tube member's top and bottom ends, at least the top end and a portion of the sidewall of the bubble vial being positioned within the opening of the tube member, and a pipe fitting having at least one connector adapted for engaging a pipe member, at least one of the top and bottom ends of the tube member being matingly engaged with the pipe fitting connector.

Other features and advantages of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF PREFERRED EMBODIMENTS

Figure 1:
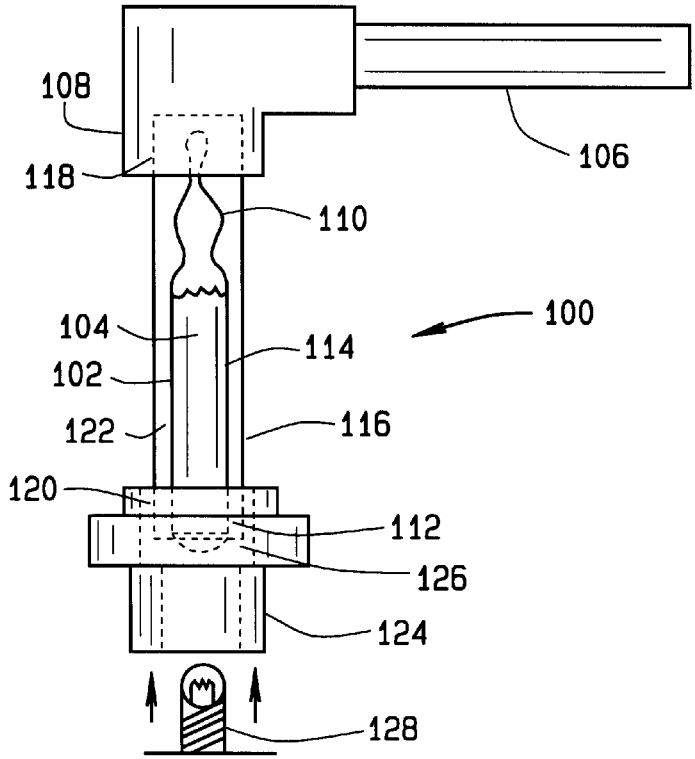
FIG. 1 is a side view of a model train accessory according to one embodiment of the present invention illustrating a bubble vial coupled to a pipe member to simulate the flow of liquid through the bubble vial and pipe member.

Referring now to the drawings, a model train accessory according to one preferred embodiment of the present invention is shown in FIG. 1 and is designated generally by reference character 100. A bubble vial 102, such as those used in Christmas ornaments, contains a liquid 104 that bubbles when heated. The bubble vial 102 is transparent or semi-transparent such that the liquid 104 in the bubble vial 102 is visible. The bubble vial 102 is coupled to at least one pipe member 106 via a pipe fitting 108 so that the bubbles moving through the vial 102 simulate the flow of the liquid 104 to the pipe member 106. Preferably, the pipe member 106 is a standard ½" PVC water pipe and the pipe fitting 108 is a ½" PVC water pipe fitting such as an "elbow," "tee," or "adaptor." As shown in FIG. 1, the pipe fitting 108 is an "elbow" fitting which allows the bubble vial 102 to be positioned within one end of the fitting 108 and coupled with one pipe member 106. The pipe fitting 108 may also be a "tee" or "adaptor" fitting (not shown) or the like to allow the bubble vial 102 to be positioned within one end of the tee or adaptor and coupled with more than one pipe member connected to other ends of the tee or adaptor.

In one preferred embodiment of the invention, the outer diameter of the bubble vial 102 is approximately equal to or at least as great as the outer diameter of the pipe member 106 to simulate an authentic pipeline.

In another preferred embodiment, the bubble vial 102 has a top end 110, a bottom end 112, and a sidewall 114 extending between the top end 110 and bottom end 112. A tube member 116 has a top end 118 positioned within and engaging fitting 108, a bottom end 120 and an opening 122 extending between the tube member's top end 118 and bottom end 120. At least the top end 110 of the bubble vial 102 and a portion of the sidewall 114 of the bubble vial 102 is coaxial with and positioned within the opening 122 of the tube member 116. The tube member 116 is preferably transparent or semi-transparent such that the liquid 104 in the bubble vial 102 is visible through the tube member 116. Preferably, the tube member 116 is comprised of clear plexiglass tubing with an outside diameter of ⅝" and a wall thickness of 0.060. In one preferred embodiment, the outer diameter of the tube member 116 is approximately equal to or at least as great as the outer diameter of the pipe member 106 to simulate an authentic pipeline.

As shown in FIG. 1, the model train accessory 100 may further comprise a pipe fitting 124 having at least one opening 126. The bottom end 112 of the bubble vial 102 and the bottom end 120 of the tube member are received in the pipe fitting opening 126. The pipe fitting 124 is preferably a ½" threaded pipe adaptor. The model train accessory 100 may also comprise a light assembly 128 associated with the bubble vial 102 for directing heat and light into the bubble vial. The light assembly 128 may be coupled to the bubble vial 102 by being received withing pipe fitting 124.

Figure 2:
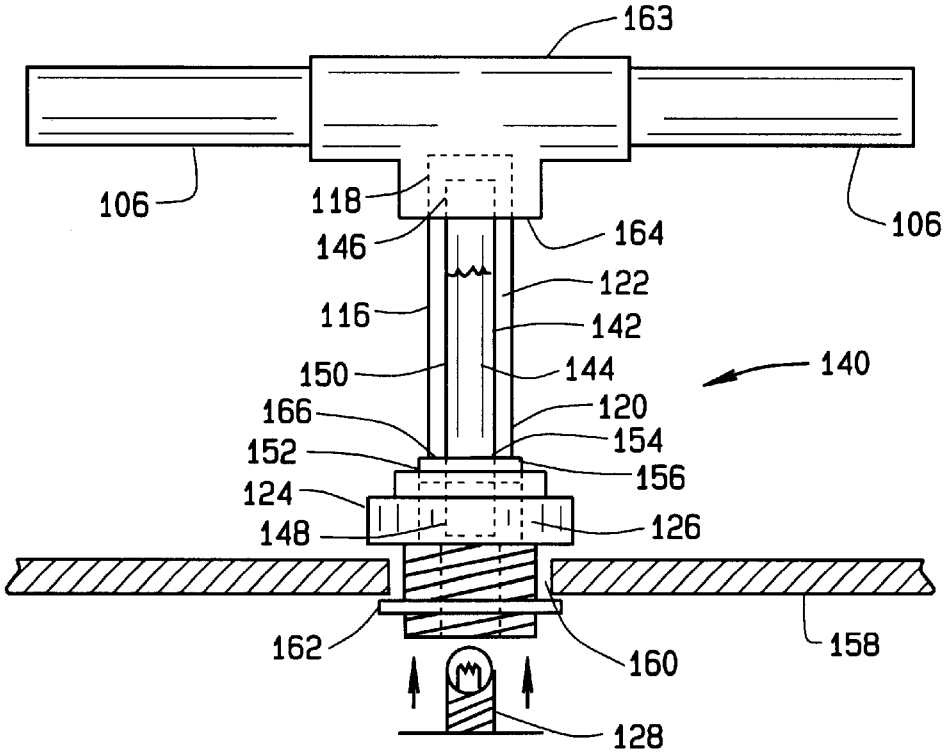
FIG. 2 is a side view partially in cross section of a model train accessory according to another embodiment of the present invention illustrating the use of a grommet to secure a vessel containing a liquid to a pipe fitting.

FIG. 2 illustrates a model train accessory according to another preferred embodiment of the present invention designated generally by reference character 140. A vessel 142 for containing a liquid 144 has a top end 146, a bottom end 148 and a sidewall 150 extending between the top end 146 and bottom end 148. The vessel 142 is preferably transparent or semi-transparent such that a liquid 144 in the vessel 142 is visible. The model train accessory 140 further comprises a pipe fitting 124 having at least one opening 126 adapted for receiving bottom end 148. A grommet 152 has an inner peripheral edge 154 and an outer peripheral edge 156. The inner peripheral edge 154 extends about and engages the bottom end 148 and sidewall 150 of the vessel 142. The outer peripheral edge 156 is seated within and engages the opening 126 of the pipe fitting 124 to secure the vessel 142 to the pipe fitting 124. Preferably, the pipe fitting opening 126 and the grommet 152 are circular. In addition, the grommet 152 is preferably rubber. For example, a Buchanan #774138 ⅜" I.D. grommet is preferably used. The grommet 152 is sized to be compressed between the opening 126 and the bottom end 148.

As illustrated in FIG. 2, the pipe fitting 124 may be a threaded pipe adaptor attachable to a support surface 158 by being located within a hole 160 therethrough and held in place by a nut 162. The hole 160 in the support surface is preferably ⅞" and the nut 162 engaging the threads of the adaptor is preferably a ½" metal locknut. The support surface 158 may be a train board supporting a model train layout, or a platform having sides and a top to be placed on a model train layout. If a platform is used, a ¾" dimension on the underside of the platform top is preferable to offer sufficient room for fastening the pipe fitting 124 to the platform top. In addition, a platform size of 5"×15" has been found to be very adaptable in constructing various sizes of pipelines incorporating the model train accessory of the present invention. Model trains and model train accessories (not shown) may be placed on and/or around the platform to create a more authentic feel to the model train layout.

The model train accessory 140 shown in FIG. 2 may further comprise a device, such as a light assembly 128, received within the pipe fitting 124 for directing heat through the pipe fitting opening 126 to thereby heat a liquid 144 contained in the vessel 142. The liquid 144 preferably bubbles when heated such that the liquid produces a simulated effect of liquid 144 flowing through the vessel 142 from the fitting 124.

As illustrated in FIG. 2, the model train accessory 140 may further comprise a second pipe fitting 163 having at least one opening 164 adapted for receiving a pipe member 106. The top end 146 of the vessel 142 extends into the opening 164 of the second pipe fitting 163 to simulate the flow of liquid through the vessel 142 and second pipe fitting 163. As shown in FIG. 2, the second pipe fitting 163 is a "tee" fitting which allows the vessel 142 to be further connected to one or two pipe members 106 via the second pipe fitting 163 to further simulate the flow of liquid from the fitting 124 through the vessel 142 to the fitting 163 and to pipe member(s) 106. As explained above, the pipe fitting 163 may also be an "elbow" or "adaptor" fitting (not shown) or the like to allow the vessel 142 to be connected with one or more pipe members 106 via the pipe fitting 163.

As illustrated in FIG. 2, the model train accessory 140 may further comprise a tube member 116 having a top end 118, a bottom end 120, and an opening 122 extending between the tube member's top end 118 and bottom end 120. At least the top end 146 and a portion of the sidewall 150 of the vessel is positioned within the opening 122 of the tube member 116. The grommet 152 has a top surface 166 and the bottom end 120 of the tube member 116 abuts against the top surface 166 of the grommet 152.

Although FIG. 2 illustrates the bottom end 120 of the tube member 116 abutting against the top surface 166 of the grommet 152, the bottom end 120 of the tube member 116 can be matingly engaged with the fitting 124 and/or abut against the grommet 152. For example, as shown in FIG. 2, the grommet 152 may be positioned in the fitting 124 such that the top surface 166 of the grommet 152 projects above the opening 126 of the fitting 124. As shown, the bottom end 120 of the tube member 116 therefore abuts against the top surface 166 of the grommet. Alternatively, the grommet 152 may be positioned in the fitting 124 such that the top surface 166 of the grommet 152 is within the opening 126 of the fitting 124. In this case, the bottom end 120 of the tube member 116 may matingly engage the fitting 124 and/or abut against the top surface 166 of the grommet 152.

Figure 3:
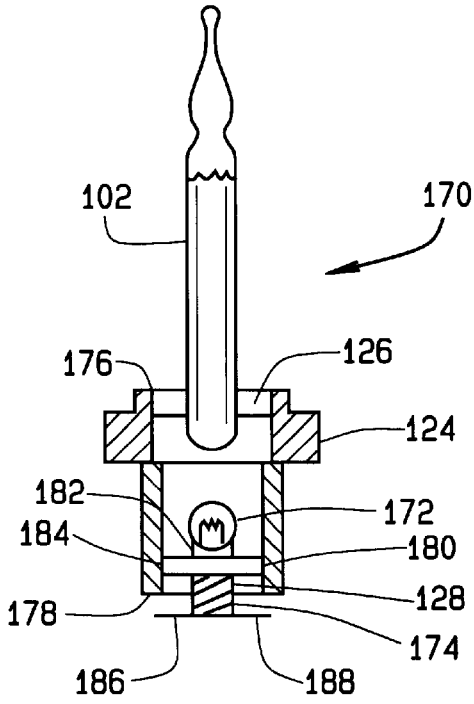
FIG. 3 is a side view partially in cross section of a model train accessory according to yet another embodiment of the present invention illustrating the use of a grommet to secure a light assembly to a pipe fitting for heating a liquid in a bubble vial.

FIG. 3 illustrates another embodiment of a model train accessory according to the present invention designated generally by reference character 170. The model train accessory 170 comprises a light assembly 128 having a bulb portion 172 and a base 174. A pipe fitting 124 has a top end 176, a bottom end 178, and at least one opening 126 extending therethrough. A grommet 180 has an inner peripheral edge 182 and an outer peripheral edge 184. The inner peripheral edge 182 extends about and engages the base 174 of the light assembly 128. The outer peripheral edge 184 is seated within and engages the opening 126 of the pipe fitting 124 in the bottom end 178 of the pipe fitting 124 to secure the light assembly 128 to the pipe fitting 124. The grommet 180 preferably comprises a rubber o-ring. In addition, the base 174 of the light assembly 128 is preferably cylindrical and includes terminals 186 and 188 extending radially outwardly such that the terminals 186 and 188 engage a peripheral edge of the pipe fitting opening 126 to act as a stop abutting against end 178 to prevent over-insertion of the light assembly 128 into the pipe fitting opening 126. The light assembly 128 preferably comprises an 18 volt clear bulb screwed into a E-10-2 socket with a contact and two terminals, such as terminals 186 and 188. Standard 22 gauge copper wire (not shown) connected to the terminals is used to energize the light bulb. Preferably, two different wire colors are used; one for the positive pole and one for the negative pole.

As further illustrated in FIG. 3, the model train accessory 170 may comprise a bubble vial 102 received within the pipe fitting opening 126 in the top end 176 of the pipe fitting 124 such that heat rising from the light assembly 128 and light from the bulb 172 are directed toward the bubble vial 102.

Figure 4:
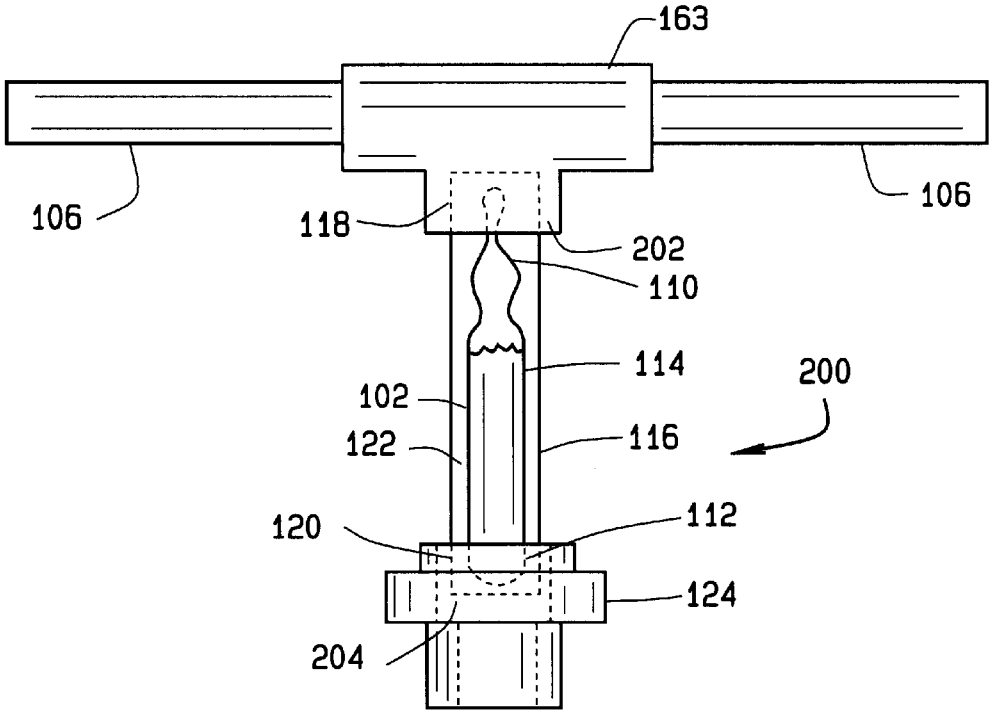
FIG. 4 is a side view of a model train accessory according to still another embodiment of the present invention illustrating a bubble vial positioned in a tube member that is engaged with pipe fittings to simulate the flow of liquid through the tube member and pipe fittings.

FIG. 4 illustrates a model train accessory according to yet another preferred embodiment of the present invention designated generally by reference character 200. A bubble vial 102 has a top end 110, a bottom end 112, and a sidewall 114 extending between the top end 110 and bottom end 112. A tube member 116 has a top end 118, a bottom end 120 and an opening 122 extending between the tube member's top end 118 and bottom end 120. At least the top end 110 of the bubble vial 102 and a portion of the sidewall 114 of the bubble vial 102 are positioned coaxially within the opening 122 of the tube member 116. The tube member 116 is preferably rigid and transparent or semi-transparent. The model train accessory 200 further comprises a pipe fitting 163 having at least one connector 202, such as a recess, adapted for engaging a pipe member such as pipe member 106. The tube member 116 is matingly engaged with the pipe fitting connector 202.

As further illustrated in FIG. 4, the model train accessory 200 may further comprise a second pipe fitting 124 having at least one connector 204 adapted for engaging a pipe member such as pipe member 106. In a preferred embodiment, the top end 118 of the tube member 116 is matingly engaged with the pipe fitting connector 202 and the bottom end 120 of the tube member 116 is matingly engaged with the second pipe fitting connector 204.

Figure 5:
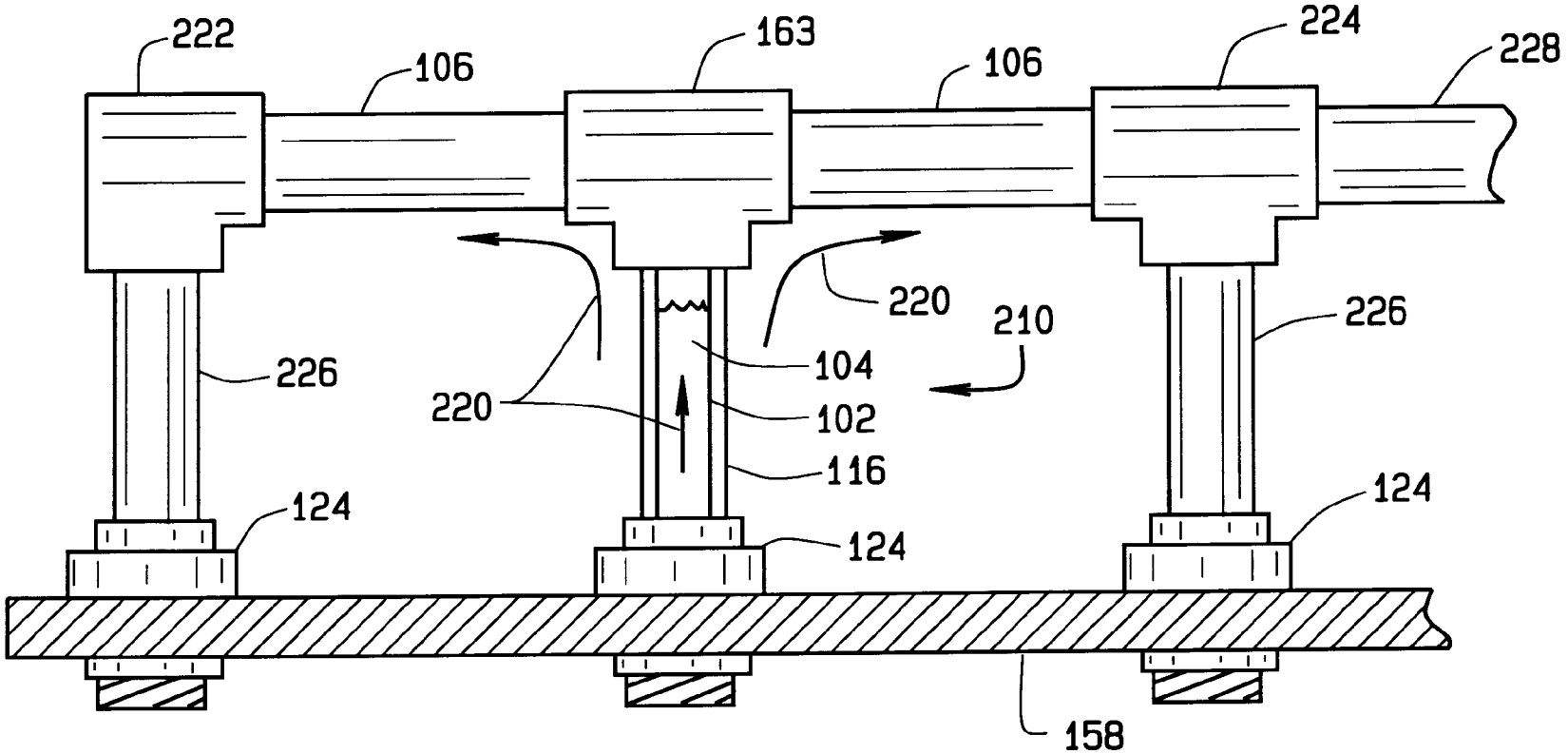
FIG. 5 is a side view partially in cross section of a model train accessory as assembled according to the present invention.

FIG. 5 illustrates a model train accessory according to the present invention designated generally by reference character 210 as assembled for placement on a model train layout. As shown in FIG. 5, a bubble vial 102 is axially positioned in a transparent tube member 116 and coupled with pipe fittings 124 and 163. The pipe fitting 163 is further coupled with pipe members 106. As the liquid 104 in the bubble vial 102 is heated by a device (not shown) located in the pipe fitting 124, the liquid 104 bubbles, producing a visual effect simulating the flow of liquid 104 from fitting 124 through the bubble vial 102 to pipe fitting 163 and pipe members 106, as indicated by arrows 220. One or more additional pipe fittings, such as pipe fittings 222 and 224, and one or more additional pipe members, such as pipe members 226 and 228, may be further coupled to pipe members 106 to create a more authentic looking pipeline wherein the liquid 104 appears to flow through the pipe members 106, 226 and 228 via pipe fittings 163, 222, and 224. The pipe members 226 are matingly engaged with pipe fittings 124 in the same manner as the bubble vial 102 and/or tube member 116 discussed above.

"As discussed above, the pipe members 106, 226 and 228 are preferably comprised of standard ½" PVC water pipe. The pipe fittings 163, 222, and 224 are preferably ½" PVC water pipe fittings such as "elbows," "tees," "adaptors" or the like. The pipe members 106, 226, and 228 may be matingly engaged with the pipe fittings 163, 222 and 224 with or without an adhesive, such as PVC cement. Pipe members 106, 226 and 228 and fittings 124, 163, 222 and 224 may be opaque to enhance the simulation effect."

The number of model train accessories 210 in a particular "pipeline" can range from 1 to any number greater than 1. For example, pipe members 106, 226 and 228 may be replaced by model train accessory 210. Devices (not shown) for heating the liquid 104 in two or more model train accessories 210 can be wired in parallel to achieve ease of operation and efficiency. In addition, pipe members 226 may comprise a tube member such as tube member 116 or a clear cast (solid) ⅝" outside diameter plexiglass bar stock. The bar stock may then be drilled to accommodate a variety of light emitting diodes or incandescence bulbs (flashing or not) to further enhance the pipelines.

Accessories such as different lengths of cut pipe, chain, valves, wheels, timbers, landscape materials, structures, animals, trees, shrubs, decals, people, and "junk" can all be used to add a more authentic feel to the pipeline and/or support surface. Painting the pipeline and/or support surface can add even greater aesthetic appeal.

When introducing elements of the present invention of the preferred embodiments thereof, the articles "a", "an", "the" and "said" are intended to mean that there are one or more of the elements. The terms "comprising", including" and "having" are intended to be inclusive and meant that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A model train accessory comprising a bubble vial, a tube member, a pipe member, and at least a first pipe fitting, the bubble vial having a top end, a bottom end, and a sidewall extending between the top end and the bottom end, the tube member having a top end, a bottom end, and an opening extending between the tube member's top and bottom ends, at least the top end and a portion of the sidewall of the bubble vial being positioned within the opening of the tube member, the bubble vial being coupled to the pipe member via the tube member and the first pipe fitting to thereby simulate the flow of liquid through said pipe member.

2. The model train accessory of claim 1 further comprising a light assembly and a second pipe fitting, the light assembly being coupled to the bubble vial via the second pipe fitting for directing heat and light into the bubble vial.

3. The model train accessory of claim 2 wherein the second pipe fitting is a threaded pipe adaptor attachable via a nut to a support surface having a hole therethrough.

4. The model train accessory of claim 2 further comprising a grommet having an inner peripheral edge and an outer peripheral edge, the inner peripheral edge of the grommet extending about and engaging the sidewall of the bubble vial, the outer peripheral edge of the grommet being seated within an opening of the second pipe fitting, the grommet thereby securing the bubble vial to the second pipe fitting.

5. The model train accessory of claim 4 wherein the bottom end of the tube member abuts against a top surface of the grommet.

6. The model train accessory of claim 2 further comprising a grommet having an inner peripheral edge and an outer peripheral edge, the inner peripheral edge of the grommet extending about and engaging a base of said light assembly, the outer peripheral edge of the grommet being seated within an opening in a bottom end of the second pipe fitting, the grommet thereby securing the light assembly to the second pipe fitting.

7. The model train accessory of claim 6 wherein the grommet comprises a rubber o-ring.

8. A model train accessory comprising a bubble vial, a first pipe fitting, and a pipe member coupled to the first pipe fitting, the first pipe fitting having at least one opening, the bubble vial being received in the opening of the first pipe fitting and thereby coupled to the pipe member to simulate the flow of liquid through said pipe member.

9. The model train accessory of claim 8 wherein the bubble vial has an outer diameter and the pipe member has an outer diameter and wherein the outer diameter of the pipe member is at least as great as the outer diameter of the bubble vial.

10. The model train accessory of claim 8 further comprising a light assembly and a second pipe fitting, the light assembly being coupled to the bubble vial via the second pipe fitting for directing heat and light into the bubble vial.

11. A model train accessory comprising:

a vessel for containing a liquid, the vessel having a top end, a bottom end, and a sidewall extending between the top end and the bottom end;

a pipe fitting having at least one opening adapted for receiving a pipe member; and a grommet having an inner peripheral edge and an outer peripheral edge, the inner peripheral edge of the grommet extending about and engaging the sidewall of the vessel, the outer peripheral edge of the grommet being seated within the opening of the pipe fitting, the grommet thereby securing the vessel to the pipe fitting;

wherein the pipe fitting is a threaded pipe adapter attachable to a support surface having a hole therethrough via a nut.

12. A model train accessory comprising:

a vessel for containing a liquid, the vessel having a top end, a bottom end, and a sidewall extending between the top end and the bottom end;

a pipe fitting having at least one opening adapted for receiving a pipe member; and a grommet having an inner peripheral edge and an outer peripheral edge, the inner peripheral edge of the grommet extending about and engaging the sidewall of the vessel, the outer peripheral edge of the grommet being seated within the opening of the pipe fitting, the grommet thereby securing the vessel to the pipe fitting;

wherein the vessel contains a liquid that bubbles when heated, the model train accessory further comprising a device connected to the pipe fitting for directing heat through said opening and into the vessel to thereby heat the liquid.

13. The model train accessory of claim 12 wherein the device is a light assembly.

14. A model train accessory comprising:

a vessel for containing a liquid, the vessel having a top end, a bottom end, and a sidewall extending between the top end and the bottom end;

a first pipe fitting having at least one opening adapted for receiving a pipe member;

a grommet having an inner peripheral edge and an outer peripheral edge, the inner peripheral edge of the grommet extending about and engaging the sidewall of the vessel, the outer peripheral edge of the grommet being seated within the opening of the first pipe fitting, the grommet thereby securing the vessel to the first pipe fitting; and a second pipe fitting having at least one opening adapted for receiving a pipe member, wherein the top end of the vessel extends into the opening of the second pipe fitting.

15. A model train accessory comprising:

a vessel for containing a liquid, the vessel having a top end, a bottom end, and a sidewall extending between the top end and the bottom end;

a pipe fitting having at least one opening adapted for receiving a pipe member; and a grommet having an inner peripheral edge, an outer peripheral edge, and a top surface, the inner peripheral edge of the grommet extending about and engaging the sidewall of the vessel, the outer peripheral edge of the grommet being seated within the opening of the pipe fitting, the grommet thereby securing the vessel to the pipe fitting; and a tube member having a top end, a bottom end, and an opening extending between the tube member's top and bottom ends, at least the top end and a portion of the sidewall of the vessel being positioned within the opening of the tube member, the bottom end of the tube member abutting against the top surface of the grommet.

16. A model train accessory comprising:

a vessel for containing a liquid, the vessel having a top end, a bottom end, and a sidewall extending between the top end and the bottom end;

a pipe fitting having at least one opening adapted for receiving a pipe member; and a grommet comprising rubber having an inner peripheral edge and an outer peripheral edge, the inner peripheral edge of the grommet extending about and engaging the sidewall of the vessel, the outer peripheral edge of the grommet being seated within the opening of the pipe fitting, the grommet thereby securing the vessel to the pipe fitting.

17. The model train accessory of claim 16 wherein the pipe fitting opening and the grommet are circular.

18. The model train accessory of claim 16 wherein the vessel is transparent.

* * * * *